US006056452A

United States Patent [19]

Nakahanada

[11] Patent Number: 6,056,452

[45] Date of Patent: May 2, 2000

[54] METHOD FOR PROCESSING SILVER HALIDE PHOTOGRAPHIC LIGHT-SENSITIVE MATERIAL

[75] Inventor: Manabu Nakahanada, Hino, Japan

[73] Assignee: Konica Corporation, Tokyo, Japan

[21] Appl. No.: 09/243,510

[22] Filed: Feb. 1, 1999

[30] Foreign Application Priority Data

Feb. 6, 1998 [JP] Japan ..... 10-041291
Feb. 9, 1998 [JP] Japan ..... 10-042843

[51] Int. Cl.[7] ..... G03D 3/08

[52] U.S. Cl. ..... 396/617; 396/622

[58] Field of Search ..... 396/617, 620, 396/622, 624, 645, 646; 226/196, 197, 198, 199; 430/375

[56] References Cited

U.S. PATENT DOCUMENTS

| | | | |
|---|---|---|---|
| 2,036,442 | 4/1936 | Tanatar | 396/616 |
| 3,435,749 | 4/1969 | Cauwe et al. | 396/646 |
| 4,174,901 | 11/1979 | Takita et al. | 396/622 |
| 5,063,401 | 11/1991 | Oberkersch et al. | 396/622 |
| 5,453,811 | 9/1995 | Yamamoto | 396/646 |
| 5,629,751 | 5/1997 | Tsumura et al. | 396/622 |

FOREIGN PATENT DOCUMENTS

| | | |
|---|---|---|
| 2-37345 | 2/1990 | Japan . |
| 9-211823 | 8/1997 | Japan . |
| 9-269577 | 10/1997 | Japan . |

*Primary Examiner*—Alan A. Mathews
*Attorney, Agent, or Firm*—Frishauf, Holtz, Goodman, Langer & Chick, P.C.

[57] ABSTRACT

A method for processing a silver halide color photographic light-sensitive material is disclosed. The method comprises the step of processing a color silver halide photographic material by a processing apparatus having the first processing tank in which the light-sensitive material is firstly processed, a turning portion positioned outside the processing solution between the first processing tank and the next processing tank, wherein the silver halide color photographic light-sensitive material has a coated silver amount of from 3 g/m$^2$ to 10 g/m$^2$, and a value of $R \times L_1/S$ is within the range from 1.5 to 5.0, or a value of $L_1 \times K/S$ is within the range of from 26 to 70, when R is a curvature radius in centimeter of the turning portion, $L_1$ is a length in centimeter of the portion of the first processing tank at which the light-sensitive material is immersed in a processing solution, S is a transportation speed of the light-sensitive material in the processor in centimeter per minute, and K is an opening ratio in cm$^2$/liter of the first processing tank.

6 Claims, 2 Drawing Sheets

METHOD FOR PROCESSING SILVER HALIDE PHOTOGRAPHIC LIGHT-SENSITIVE MATERIAL

FIELD OF THE INVENTION

The invention relates to an method for processing a silver halide photographic light-sensitive film, hereinafter referred to a photographic film, particularly relates to an method for processing a photographic film by which formation of a scratch on the photographic material, and jamming of the photographic film are inhibited and a suitable image gradation is obtained and formation of a stain is prevented even when a rapid processing is performed.

BACKGROUND OF THE INVENTION

Recently, a demand to increase the processing speed of photographic material is considerably raising. On the other hand, a demand to make compact an automatic processing apparatus, hereinafter referred to automatic processor, is also raised accompanied with increasing in number of mini-lab.

For responding to such the situation, Japanese Patent Publication Open for Public Inspection, hereinafter referred to JP O.P.I., Nos. 9-269575 and 9-269577 disclose a technology relating to the length of processing portion and the transporting speed in the automatic processor for a silver halide photographic light-sensitive material, hereinafter referred to a light-sensitive material. JP O.P.I. No. 9-211823 discloses a technology relating to the curvature of the bottom of processing tank additionally to the length of the processing portion and the transporting speed.

However, it is found that the scratch formation and jamming of the light-sensitive material at a turning portion outside the processing solution where the light-sensitive material is not immersed in the solution cannot be inhibited by the above-mentioned technology.

The technology disclosed in JP O.P.I. No. 9-211823 is only relates to the curvature of the bottom of processing tank and the contents of the disclosure are quite different from the constitution and the object of the present invention for solving the problems at the turning portion outside the processing solution.

It is an effective means for realizing compactness of the processor to decrease the curvature radius R of a turning rack positioned outside the processing solution. However, when the curvature radius is made excessively decreased, the light-sensitive material cannot be smoothly transported and the emulsion surface of the light-sensitive material is touched to the upper or lower potion of the turning rack positioned outside the processing solution since the light-sensitive material has a rigidity, and scratches are formed on the light-sensitive material. As a result of that, the commercial value of the photographic material is lost.

Swelling of a gelatin layer coated on the light-sensitive material is started at the moment of immersing the light-sensitive material into a processing solution. In the processing tank in which the light-sensitive material is firstly processed, the occurring frequency of jamming and scratch formation at the turning portion outside the processing solution are varied since the rigidity of the light-sensitive material is changed according to the length of immersing portion of in processing tank $L_1$ and the transporting speed of the light-sensitive material S.

Moreover, jamming of the light-sensitive material at rollers of transportation guide tend to frequently occur when the transporting speed is made higher.

On the other hand, it is necessary to raise the activity of the processing solution for realizing a rapid processing. A concentration of the processing solution and a stirring speed of the processing solution are made higher for such the purpose. Under such the conditions, a precipitation tends to be caused by degradation of the processing solution. Particularly, a solid substance or a precipitation is frequently adhered to a turning portion outside the processing solution between the processing tanks since the processing solution adhered in such the portion is easily to be evaporated and oxidized by air. When the solid substance or precipitation is formed in the turning portion outside the processing solution, the gelatin layer of the light-sensitive material which is swelled and softened by the processing solution is easily scratched at the time of passing the turning portion.

Moreover, the solid substance or precipitation formed in the turning portion outside the processing solution is adhered on the image formed area of the light-sensitive material. The solid substance or precipitation adhered on the light-sensitive material causes a undesirable increasing of the image density or a stain, and the image is made unsuitable for printing on a color paper.

Technology relating a processor having a suitable opening area ratio for each of the processing solutions is disclosed in, for example, JP O.P.I. Nos. 62-105140 and 7-120900.

In a small photo-shop, in which, it is difficult to prevent the formation of scratch, jamming and stain by the know countermeasures since an amount of the light-sensitive material to be processed is small and a renewal ratio of the processing solution is considerably low.

SUMMARY OF THE INVENTION

The object of the invention is to provide a method for processing a light-sensitive material by which the frequency of occurrence of scratch and jamming of the light-sensitive material can be lowered, a suitable gradation can be obtained and a stain can be inhibited even when a rapid processing is applied.

The object of the invention can be attained by a method for processing a silver halide photographic light-sensitive material comprising the step of processing a color silver halide photographic material by a processing apparatus having the first processing tank in which the light-sensitive material is firstly processed, a turning portion positioned outside the processing solution between the first processing tank and the next processing tank, wherein the silver halide color photographic light-sensitive material has a coated silver amount of from 3 $g/m^2$ to 10 $g/m^2$, and a value of $R \times L_1/S$ is within the range from 1.5 to 5.0, or a value of $L_1 \times K/S$ is within the range of from 26 to 70, when R is a curvature radius in centimeter of the turning portion, $L_1$ is a length in centimeter of the portion of the first processing tank at which the light-sensitive material is immersed in a processing solution, S is a transportation speed of the light-sensitive material in the processor in cm/minute, and K is an opening ratio in $cm^2$/liter of the first processing tank.

DETAILED DESCRIPTION OF THE INVENTION

In the processor relating to the invention, the turning portion positioned outside the processing solution between the first processing tank in which the light-sensitive material is firstly processed, hereinafter referred to the first processing tank, and the next processing tank has a value of $R \times L_1/S$ within the range of from 1.5 to 5.0, preferably 2.0 to 4.0, or the first processing tank has a value of $L_1 \times K/S$ within the range of from 26 to 70, more preferably 35 to 65, wherein R is a curvature radius in centimeter of the turning portion, $L_1$ is a length in centimeter of the portion of the first processing tank in which the light-sensitive material is immersed in the processing solution, S is a transportation speed of the light-sensitive material in the processing portion of the processor in centimeter per minute, and K is an opening ratio in $cm^2$/liter of the first processing tank.

Figure 1:
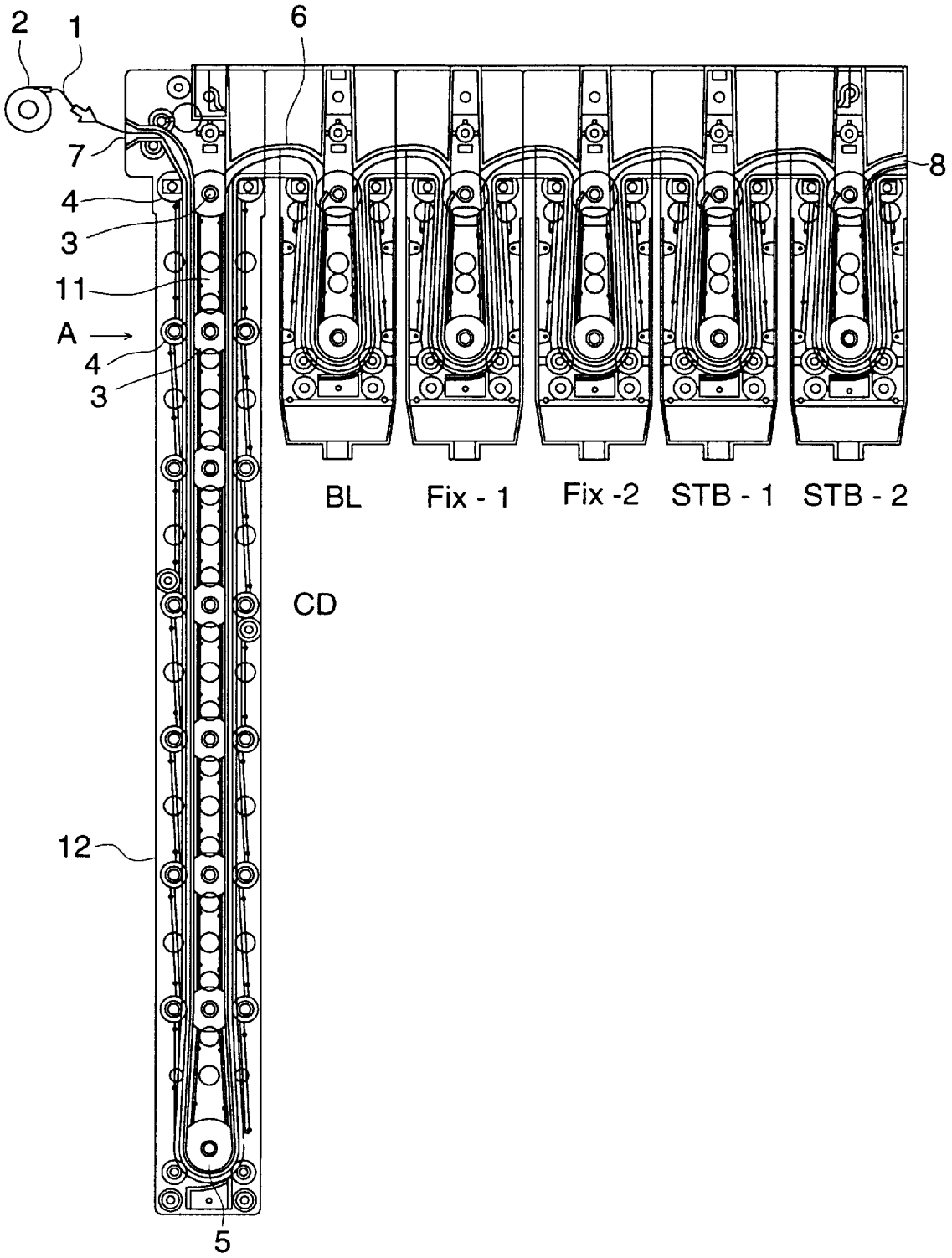
FIG. 1 shows a cross section of an automatic processor relating to the invention.

A cross section of an embodiment of the processing portion of a processing processor usable in the invention is shown in FIG. 1.

The processing portion of the automatic processor shown in FIG. 1 is composed of a rack 11 and a tank 12 and a processing solution is maintained in the space formed by the tank and the rack. A light-sensitive material 1 is take out from a cartridge 2 and transported by a transporting means which is not shown in the figure, without use of a short leader, and introduced into a color developing tank CD through a inlet 7, and transported by a transporting roller 3 and a counter roller 4. In FIG. 1, the light-sensitive material is transported downward in the left side of the rack and moved to right side by a reversing roller 5 and transported upward. Then the light-sensitive material is introduced into a bleaching tank through a turning portion 6 positioned outside processing solution, hereinafter simply referred to turning portion. Thereafter, the light-sensitive material is similarly transported to be sequentially processed in a fist fixing tank Fix-1, a second fixing tank Fix-2, a first stabilizing tank STB-1 and a second stabilizing tank STB-2, and put out from the processing portion through an outlet 8, and dried in a drying zone which is not shown in the drawing.

Figure 2:
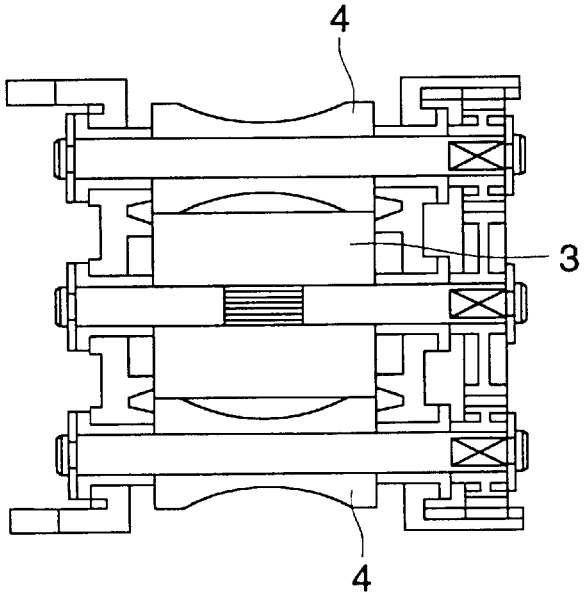
FIG. 2 shows a cross section of a rack at the position indicated by arrow A.

A cross section of the transporting roller 3 and the counter roller 4 in the rack 11 at the portion indicated by the arrow sign is shown in FIG. 2. As is shown in FIG. 2, the counter roller 4 is a concave roller, and the light-sensitive material is held at the perforated portion by the transporting roller 3 and the counter roller 4 and transported.

Although the curvature radius of the turning portion positioned outside processing solution is uniformly 2.0 cm in the processor shown in FIG. 1, the preferable range of the curvature radius of the turning portion is within the range of from 0.9 cm to 3.0 cm, and more preferably 1.2 cm to 2.4 cm from the viewpoint of inhibition of jamming and scratch formation.

The turning portion positioned 6 preferably has plural portions each having a different curvature radius. It is preferable for inhibiting jamming that the curvature radius of the turning portion is smaller at the initial and terminal parts than that at the central part of the turning portion. In the invention, the smallest curvature radius is defined as the curvature radius of the turning portion when the turning portion has plural part different in the curvature radius thereof.

The length of immersing portion $L_1$ is a length from the point at which the light-sensitive material is contacted to the processing solution in the processing tank to the point at which the light-sensitive material is take out from the processing solution. In the invention, a preferable range of the length of the immersing portion in the first processing tank is within the range of from 45 cm to 150 cm, more preferably from 60 cm to 120 cm, even though the length of the immersion portion of the color developing tank is 100 cm in the processor shown in FIG. 1.

The ratio $L_2/L_1$ of the length $L_2$ cm of the turning portion bridging the processing tank in which the light-sensitive material is firstly processed to the next tank, to the length $L_1$ cm of the processing tank in which the light-sensitive material is firstly processed is preferably within the range of from 0.03 to 0.10, more preferably from 0.04 to 0.07, even though the ratio is 0.05 in the processor shown in FIG. 1.

The transporting speed of the light-sensitive material in the processor relating to the invention is preferably within the range of from 40 cm/min. to 133 cm/min. and more preferably from 50 cm/min. to 100 cm/min. from the viewpoint of inhibiting jamming, even though the transporting speed in the processor shown in FIG. 1 is set at 60 cm/min.

In the processor according to the invention, the light-sensitive material may be used for transported by means of a short leader, a transporting roller holding a non image formed portion of the light-sensitive material, or a transporting roller holding a image formed portion of the light-sensitive material.

The volume of the processing tank of the processor according to the invention is preferably within the range of from 0.5 liters to 10 liters, more preferably from 2 liter to 5 liter. In the processor shown in FIG. 1, the volume of the color developing tank is 5.0 liters and that of the other tanks are each 2.5 liters. The volume of the processing tank includes that of a reserve tank.

The curvature radius of the inverting roller in the first processing tank is preferably from 0.5 cm to 4.0 cm, more preferably from 1.0 cm to 2.5 cm. In the processor shown in FIG. 1, the curvature radius of the inverting roller is set at 1.8 cm.

The opening area ratio of the processing tank in which the light-sensitive material is firstly processed is preferably within the range of from 10 $cm^2$/liter to 55 $cm^2$/liter, more preferably from 20 $cm^2$/liter to 45 $cm^2$/liter from the viewpoint of the formation of scratch or stain. In the processor shown in FIG. 1, the opening ratio is 35 $cm^2$/liter.

It is preferable in the processor relating to the invention that the value of $L_1 \times K/S$ is within the range of from 26 to 70, more preferably 35 to 65, when $L_1$ is a length in centimeter of the immersing portion in the first processing tank, K is an opening ratio in $cm^2$/liter of the first processing tank, and S is a transporting speed in cm/min. of the light-sensitive material in the processing portion.

A circulation amount of the processing solution in the processing tank of the processor relating to the invention is preferably within the range of from 1.0 liters/min. to 10 liter/min., more preferably from 3.0 liter to 7.0 liters from the viewpoint of stable temperature control of the processing solution. In the processor shown in FIG. 1, the circulation amount is 5.0 liters/min. in the color developing tank and 3.0 liters/min. in the other tanks.

Any processing solution having a usual composition is usable in the invention. Example of a color developing solution, a processing solution having a bleaching ability, a solution having a fixing ability and a stabilizing solution are described in JP O.P.I. No. 9-211823.

In the invention, the coating amount of silver of the light-sensitive material is an amount of silver coated on the support of light-sensitive material, and the amount is described in terms of silver. The coating amount of the light-sensitive material to be used in the invention is within the range of from 3.0 g/m$^2$ to 10.0 g/m$^2$, more preferably from 4.0 g/m$^2$ to 7.0 g/m$^2$.

The light-sensitive material may be one containing silver chloride, silver chlorobromide, silver bromide, or silver iodobromide. A light-sensitive material containing a high-speed silver bromide or silver iodobromide is preferred. The support to be used in the light-sensitive material is preferably transparent support such as a plastic film.

The light-sensitive material may have multi-layered silver halide emulsion layers, and emulsion layers may be coated on one or both sides of the support. The light-sensitive material may have a magnetic recording layer containing a magnetic material.

EXAMPLES

Example 1

Samples of color light-sensitive material each having a coated silver amount of 2.5 g/m$^2$, 3.0 g/m$^2$, 4.0 g/m$^2$, 5.0 g/m$^2$, 7.0 g/m$^2$, 10.0 g/m$^2$ and 15.0 g/m$^2$, respectively, were prepared according to the description in Example 1 of JP O.P.I. No. 9-211823. The samples were silt and perforated in a format of 35 mm negative film for 24 exposures. The samples were processed by the processor shown in FIG. 1. The curvature radius R of the turning portion, the length of immersing portion $L_1$ of the color developing tank and the transporting speed S of the light-sensitive material were changed as shown in Table 1.

Five hundreds rolls of each of the samples were continuously processed in a rate of 100 rolls per day. In the course of the processing, number of jammed roll at the turning portion between the color developing tank and the bleaching tank was counted. After processing of the 500 rolls of sample, the turning portions other than the turning portion between the color developing tank and the bleaching tank was cleaned by washing with water, and the sample wedge-wise exposed to light by an ordinary manner is processed for evaluating the gradation property. The gradation property was evaluated by the following procedure. Moreover, scratches formed on the processed sample was visually evaluated according to the following standard. Thus obtained results are shown in Table 1.

Processing conditions

| | Processing time (Sec.) | Processing temperature (° C.) | Replenishing amount (ml/m$^2$) |
|---|---|---|---|
| Color developing | $L_1$/S + 5 | 42 | 500 |
| Bleaching | 23 | 39 | 130 |
| Fixing-1 | 23 | 39 | |
| Fixing-2 | 23 | 39 | 700 |
| Stabilizing-1 | 23 | 39 | |
| Stabilizing-2 | 23 | 39 | 700 |

The crossover time between each of the processes was 5 seconds and the fixing process and the stabilizing process was performed by a counter current method from the second bath to the first bath.

Evaluation of the gradation property

A characteristic curve, D-log E curve, of each of the processed samples was measured and the slope γR of a straight line connecting a density point of the minimum density +0.3 with that of the minimum density +1.3 on the characteristic curve of the yellow image was determined. Besides, each of the samples was processed by an automatic processor CL-PK50QA, manufactured by Konica Corp., using replenishers and starters for CNK-4-52 process, manufactured by Konica Corp., and the slope γN of characteristic curve of an yellow image formed on the processed sample was determined. The ratio of γR to γN, γR/γN, was determined as an indicator of the gradation property. A value of γR/γN nearer to 1.00 corresponds to a higher gradation property. The combination of the processor CL-PK50QA and CNK-4-52 is a processing system for color negative film usually used on the market. The developing time in this processing system is 3 minutes and 15 seconds and the value of R×$L_1$/S the processor is larger than 5.0. Accordingly, the processing by this system is not a rapid processing and is not included in the scope of the invention.

Evaluation standard of scratch formation

A : No scratch is observed.

B : Scratches are slightly observed at the perforated area.

C : scratches are observed at the perforated area, but no scratch is observed in the image formed are.

D : Scratches are formed in the image forming area.

TABLE 1

| Exp. No. | Coated silver amount (g/m$^2$) | R (cm) | $L_1$ (cm) | S (cm/min) | R × $L_1$/S | Number of jammed roll | Scratche formation | Gradation property |
|---|---|---|---|---|---|---|---|---|
| 1-1 | 5.0 | 0.8 | 100 | 60 | 1.33 | 9 | D | 0.98 |
| 1-2 | 5.0 | 0.9 | 100 | 60 | 1.50 | 3 | B | 1.00 |
| 1-3 | 5.0 | 1.2 | 100 | 60 | 2.00 | 1 | A | 1.00 |
| 1-4 | 5.0 | 2.0 | 100 | 60 | 3.33 | 0 | A | 1.00 |
| 1-5 | 5.0 | 2.4 | 100 | 60 | 4.00 | 1 | A | 1.00 |
| 1-6 | 5.0 | 3.0 | 100 | 60 | 5.00 | 2 | B | 1.00 |
| 1-7 | 5.0 | 3.3 | 100 | 60 | 5.50 | 5 | C | 0.98 |
| 1-8 | 5.0 | 2.0 | 40 | 60 | 1.33 | 8 | D | 0.83 |
| 1-9 | 5.0 | 2.0 | 45 | 60 | 1.50 | 4 | B | 0.93 |
| 1-10 | 5.0 | 2.0 | 60 | 60 | 2.00 | 1 | A | 0.97 |
| 1-11 | 5.0 | 2.0 | 120 | 60 | 4.00 | 1 | A | 1.05 |
| 1-12 | 5.0 | 2.0 | 150 | 60 | 5.00 | 2 | B | 1.08 |
| 1-13 | 5.0 | 2.0 | 165 | 60 | 5.50 | 3 | C | 1.15 |
| 1-14 | 5.0 | 2.0 | 100 | 150 | 1.33 | 9 | D | 0.87 |
| 1-15 | 5.0 | 2.0 | 100 | 133 | 1.50 | 4 | B | 0.95 |

TABLE 1-continued

| Exp. No. | Coated silver amount ($g/m^2$) | R (cm) | $L_1$ (cm) | S (cm/min) | $R \times L_1/S$ | Number of jammed roll | Scratche formation | Gradation property |
|---|---|---|---|---|---|---|---|---|
| 1-16 | 5.0 | 2.0 | 100 | 100 | 2.00 | 1 | A | 0.98 |
| 1-17 | 5.0 | 2.0 | 100 | 50 | 4.00 | 1 | A | 1.03 |
| 1-18 | 5.0 | 2.0 | 100 | 40 | 5.00 | 2 | B | 1.06 |
| 1-19 | 5.0 | 2.0 | 100 | 36.3 | 5.51 | 3 | C | 1.12 |
| 1-20 | 2.5 | 2.0 | 100 | 60 | 3.33 | 8 | C | 0.87 |
| 1-21 | 3.0 | 2.0 | 100 | 60 | 3.33 | 3 | B | 0.95 |
| 1-22 | 4.0 | 2.0 | 100 | 60 | 3.33 | 1 | A | 0.98 |
| 1-23 | 7.0 | 2.0 | 100 | 60 | 3.33 | 1 | A | 1.02 |
| 1-24 | 10.0 | 2.0 | 100 | 60 | 3.33 | 3 | B | 1.05 |
| 1-25 | 10.5 | 2.0 | 100 | 60 | 3.33 | 9 | D | 1.12 |

As is shown in Table 1, the occurring of jamming formation and scratches can be inhibited when the silver coating amount of the light-sensitive material is within the range of from 3.0 $g/m^2$ to 10 $g/m^2$, and the value of $R \times L_1/S$ is within the range of from 1.5 to 5.0.

Example 2

The sample in Experiment 1-1 having a coated silver amount of 5.0 $g/m^2$ was subjected to the continuous processing in the same manner as in Example 1, except that the passing length $L_2$ in centimeter of the turning portion between the color developing tank and the bleaching tank was changed as shown in Table 2, so as to change the ratio of the length $L_2$ to the immersing length in the color developing tank $L_1$, and the curvature radius R in centimeter of the turning portion as shown in Table 2. The length of $L_1$ and the transportation speed of light-sensitive material were fixed at 100 cm and 60 cm/min., respectively.

Six hundreds rolls of the sample were processed in a rate of 100 rolls per day. A number of jammed roll was counted in the course of the continuous processing, and a stability of gradation was determined in the following manner. Thus obtained results are shown in Table 2.

Evaluation of the graduation stability

At the initial time and after the completion of the continuous processing, the sample wedgewise exposed were processed, and the characteristic curves of the processed samples were prepared. Then a slope $\gamma_1$ of the straight line connecting a density point of the minimum density +0.3 and that of the minimum density +1.3 on the characteristic curve of yellow image of the sample processed at the initial time of the continuous processing, and a slop $\gamma_2$ determined on the characteristic curve of the sample processed after the completion of the continuous processing. The difference of the $\gamma_2$ and, $\gamma_2-\gamma_1=\Delta\gamma$, was determined for an indicator of the gradation stability. A value of the $\Delta\gamma$ nearer 0.00 corresponds to higher gradation stability.

TABLE 2

| Exp. No. | $L_2$ (cm) | $L_2/L_1$ | R (cm) | Number of jammed roll | Gradation stability ($\Delta\gamma$) |
|---|---|---|---|---|---|
| 2-1 | 5 | 0.05 | 0.8 | 9 | −0.08 |
| 2-2 | 2 | 0.02 | 2.0 | 5 | −0.04 |
| 2-3 | 3 | 0.03 | 2.0 | 3 | −0.02 |
| 2-4 | 4 | 0.04 | 2.0 | 1 | −0.01 |
| 2-5 | 5 | 0.05 | 2.0 | 0 | 0.00 |
| 2-6 | 7 | 0.07 | 2.0 | 1 | −0.01 |

TABLE 2-continued

| Exp. No. | $L_2$ (cm) | $L_2/L_1$ | R (cm) | Number of jammed roll | Gradation stability ($\Delta\gamma$) |
|---|---|---|---|---|---|
| 2-7 | 10 | 0.10 | 2.0 | 2 | −0.03 |
| 2-8 | 11 | 0.11 | 2.0 | 4 | −0.05 |

As is shown in Table 2, the jamming of light-sensitive material can be inhibited and a high gradation stability can be obtained when the ratio of the pass length $L_2$ of the turning portion to the immersing length $L_1$ in the color developing tank, $L_2/L_1$, is within the range of from 0.03 to 0.10.

Example 3

The sample light-sensitive material the same as that used in Example 1—1 was processed in the processor shown in FIG. 1, provided that a ratio of open area of the color developing tank and the curvature radius of the turning portion R were changed as shown in Table 3. The processing was continuously performed in the same manner as in Example 2. A gradation stability of cyan image was evaluated in the similar manner to that in Example 2. Each of the samples step wise exposed to light in an ordinary manner were processed at the initial time and after completion of the continuous processing and a stain formed on the processed sample was evaluated in the following manner. Thus obtained results are shown in Table 3.

Evaluation of stain

A transmission density at the portion of minimum density of the processed sample was measured at 440 nm. The difference between the minimum density $D_{min\ 1}$ of sample processed at the initial time of the continuous processing and the minimum density $D_{min\ 1}$ of the sample processed after completion of the continuous processing $\Delta D$ was determined as a indicator of the stain formation. A value of $\Delta D$ nearer 0.00 is suitable.

TABLE 3

| Exp. No. | Opening area ratio ($cm^2/l$) | R (cm) | Gradation stability $\Delta\gamma$ | Stain $\Delta D$ |
|---|---|---|---|---|
| 3-1 | 35 | 0.8 | −0.12 | 0.14 |
| 3-2 | 8 | 2.0 | 0.04 | 0.03 |
| 3-3 | 10 | 2.0 | 0.02 | 0.01 |
| 3-4 | 20 | 2.0 | 0.01 | 0.00 |

TABLE 3-continued

| Exp. No. | Opening area ratio ($cm^2/l$) | R (cm) | Gradation stability Δγ | Stain ΔD |
|---|---|---|---|---|
| 3-5 | 35 | 2.0 | 0.00 | 0.00 |
| 3-6 | 50 | 2.0 | −0.01 | 0.01 |
| 3-7 | 100 | 2.0 | −0.03 | 0.03 |
| 3-8 | 110 | 2.0 | −0.05 | 0.05 |

As is shown in Table 3, a high gradation stability and a lower stain can be obtained when the opening area of the processing tank in which the light-sensitive material is firstly processed is within the range of from 10 $cm/^2/l$ to 100 $cm^2/l$.

Example 4

Figure 3:
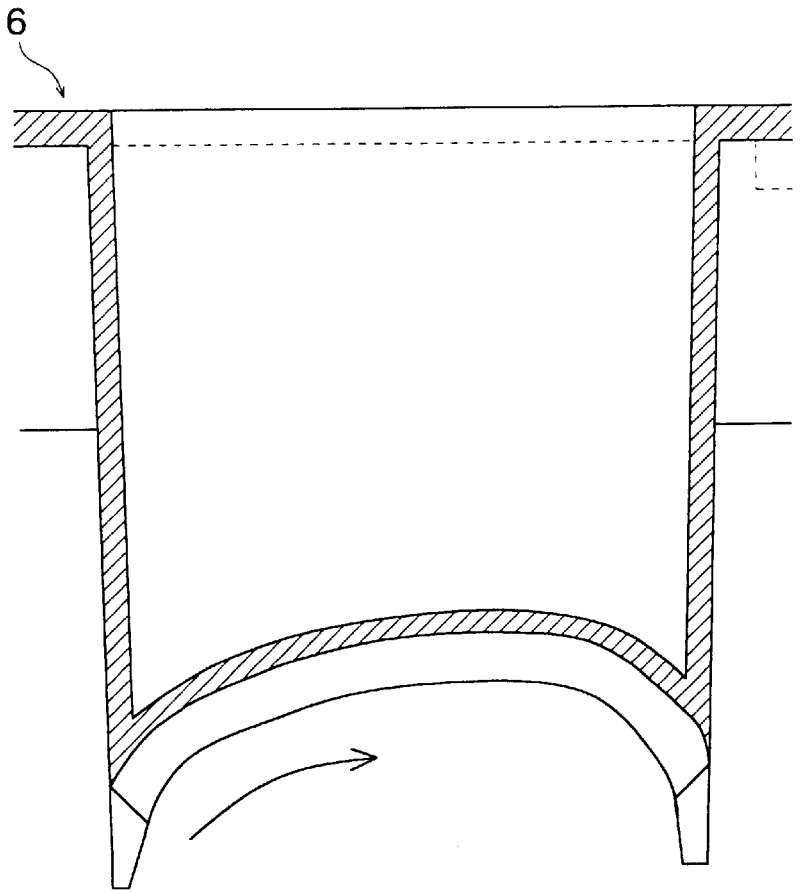
FIG. 3 shows a cross section of a turning rack.

A turning portion as shown in FIG. 3, referred to Turning Portion 2, was prepared, which is suitably usable in the invention. The light-sensitive material is moved in the direction of the arrow in the turning portion. In this turning portion, the curvature radius was sequentially changed so as to be 1.5 cm, 5.4 cm and 1.8 cm along the moving direction of light-sensitive material. The total length of the turning portion was 5 cm. On the other hand, the turning portion having a constant curvature radius of 2.0 cm used in Example, referred to Turning Portion 2, and turning portion having a constant curvature radius of 0.8 cm, referred Turning Portion 1, were prepared, which are the same as those used in Experiments 1-1 or 1-4. One thousand rolls of the sample of light-sensitive material used in Experiment 1-1 was continuously processed in a rate of 100 rolls per day by each of the processors each having Turning Portion 1 through 3, respectively as shown in Table 4.

A number of jammed roll of light-sensitive material was counted in the course of the continuous processing. Moreover, the turning portion between the color developing tank and the bleaching tank was washed by water after completion of the continuous processing and a roll of the light-sensitive material was processed and scratched formed on the processed sample was visually evaluated according to the standard described in example 1. Thus obtained results are shown in Table 4.

TABLE 4

| Exp. No. | Turning Portion | Curvature radius (cm) | Number of jammed rolls | Scratch formation |
|---|---|---|---|---|
| 4-1 | 1 | 0.8 | 20 | D |
| 4-2 | 2 | 2.0 | 2 | B |
| 4-3 | 3 | 1.5, 5.4, and 1.8 | 0 | A |

As is shown in Table 4, the occurrence of jamming and the formation of scratch are inhibited and the effects of the invention are enhanced when the turning portion has a plurality curvature radius.

Example 5

In the processor shown in FIG. 1, the immersing length in the color developing tank $L_1$ cm, the opening area ratio of the color developing tank K $cm^2$/liter and the transportation speed of the light-sensitive material S cm/min. were changed as shown in Table 5. The opening area ratio was changed by putting a part on the surface of the processing solution in the processing tank. The samples of light-sensitive material used in Example 1 each having a coated amount of silver shown in Table 5 are processed in the processor using a developing solution and replenishing solution described in Example 2 of JP O.P.I. No. 9-909585 and a tank solution and a replenishing solution of a bleaching solution, fixing solution and stabilizing solution described in JP O.P.I. No. 9-211823, the replenishing solution for the fixing solution was diluted by 3 times in the use. The processing was continuously for 5 days in a rate of 100 rolls per day. The sample wedgewise exposed to light in an ordinary manner was processed after continuous processing. The gradation property, the stain were evaluated in the same procedure in the forgoing Examples. Furthermore, a paper print of each of the processed samples, and the situation of scratches formed on the sample was evaluated on the printed image. The processing conditions were as follows.

| | Processing time (Sec.) | Processing temperature (° C.) | Replenishing amount ($ml/m^2$) |
|---|---|---|---|
| Color developing | $L_1/S + 5$ | 42 | 260 |
| Bleaching | 23 | 39 | 130 |
| Fixing-1 | 23 | 39 | |
| Fixing-2 | 23 | 39 | 700 |
| Stabilizing-1 | 23 | 39 | |
| Stabilizing-2 | 23 | 39 | 700 |

The crossover time between each of the processes was 5 seconds and the fixing process and the stabilizing process was performed by a counter current method from the second to the first bath.

The evaluation of scratch formation was performed according to the following standard.

5: No scratch was observed on the processed sample and the print

4: Scratches are slightly observed at the perforated portion of the sample but not observed in the printed image.

3: Scratches are formed at the perforated portion of the sample but nor scratch is observed in the printed image.

2: Scratches are slightly formed in the image area of the sample and a little number of line is observed in the printed image.

1: Many scratches are formed in the image area and lines are observed on the printed image.

TABLE 5

| Exp. No. | Coated silver amount ($g/m^2$) | K ($cm^2/l$) | $L_1$ (cm) | S (cm/min) | Processing time (sec.) | $K \times L_1/S$ | Stain ΔD | Scratch | Gradiation property |
|---|---|---|---|---|---|---|---|---|---|
| 5-1 | 5.0 | 9.0 | 100 | 60 | 105 | 15.00 | 0.07 | 2 | 1.12 |
| 5-2 | 5.0 | 10.0 | 100 | 60 | 105 | 16.67 | 0.03 | 3 | 1.05 |
| 5-3 | 5.0 | 15.8 | 100 | 60 | 105 | 26.33 | 0.62 | 4 | 1.02 |
| 5-4 | 5.0 | 21.0 | 100 | 60 | 105 | 35.00 | 0.01 | 5 | 1.01 |
| 5-5 | 5.0 | 35.0 | 100 | 60 | 105 | 58.33 | 0.00 | 5 | 1.00 |
| 5-6 | 5.0 | 42.0 | 100 | 60 | 105 | 70.00 | 0.01 | 5 | 0.98 |
| 5-7 | 5.0 | 52.5 | 100 | 60 | 105 | 87.50 | 0.04 | 3 | 0.95 |
| 5-8 | 5.0 | 57.8 | 100 | 60 | 105 | 96.33 | 0.11 | 1 | 0.88 |
| 5-9 | 5.0 | 35.0 | 25.7 | 60 | 30.7 | 14.99 | −0.05 | 3 | 0.81 |
| 5-10 | 5.0 | 35.0 | 28.6 | 60 | 33.6 | 16.68 | −0.01 | 4 | 0.94 |
| 5-11 | 5.0 | 35.0 | 45 | 60 | 50 | 26.25 | 0.00 | 5 | 0.96 |
| 5-12 | 5.0 | 35.0 | 60 | 60 | 65 | 35.00 | 0.00 | 5 | 0.99 |
| 5-13 | 5.0 | 35.0 | 120 | 60 | 125 | 70.00 | 0.01 | 5 | 1.02 |
| 5-14 | 5.0 | 35.0 | 150 | 60 | 155 | 87.50 | 0.03 | 3 | 1.05 |
| 5-15 | 5.0 | 35.0 | 165 | 60 | 170 | 96.33 | 0.08 | 2 | 1.15 |
| 5-16 | 5.0 | 35.0 | 100 | 233 | 30.8 | 15.02 | −0.03 | 1 | 0.85 |
| 5-17 | 5.0 | 35.0 | 100 | 210 | 33.6 | 16.67 | 0.00 | 3 | 0.96 |
| 5-18 | 5.0 | 35.0 | 100 | 133 | 50.1 | 26.32 | 0.00 | 4 | 0.98 |
| 5-19 | 5.0 | 35.0 | 100 | 100 | 65 | 35.00 | 0.00 | 5 | 1.00 |
| 5-20 | 5.0 | 35.0 | 100 | 50 | 125 | 70.00 | 0.00 | 5 | 1.02 |
| 5-21 | 5.0 | 35.0 | 100 | 40 | 155 | 87.50 | 0.02 | 4 | 1.04 |
| 5-22 | 5.0 | 35.0 | 100 | 36.3 | 170.3 | 96.33 | 0.09 | 3 | 1.12 |
| 5-23 | 2.5 | 35.0 | 100 | 60 | 105 | 58.33 | 0.08 | 3 | 0.88 |
| 5-24 | 3.0 | 35.0 | 100 | 60 | 105 | 58.33 | 0.04 | 4 | 0.94 |
| 5-25 | 4.0 | 35.0 | 100 | 60 | 105 | 58.33 | 0.01 | 5 | 0.98 |
| 5-26 | 7.0 | 35.0 | 100 | 60 | 105 | 58.33 | 0.01 | 4 | 1.02 |
| 5-27 | 10.0 | 35.0 | 100 | 60 | 105 | 58.33 | 0.03 | 3 | 1.07 |
| 5-28 | 10.5 | 35.0 | 100 | 60 | 105 | 58.33 | 0.07 | 1 | 1.12 |

As is shown in Table 5, the formation of stain and scratch can be inhibited and the suitable gradation property can be obtained by the rapid processing when the coated silver amount of the sample is within the range of from 3.0 $g/m^2$ to 10.0 $g/m^2$, and the value of $K \times L_1/S$ is within the range of from 16 to 95.

Example 6

In the processor shown in FIG. 1, the passing length $L_2$ of the turning portion between the color developing tank and the bleaching tank was changed so as to change the ratio of the length $L_2$ to the immersing length in the color developing tank $L_1$ shown in Table 6. A sample of light-sensitive material the same as that used in Experiment 5-5 was continuous processed for 10 days in rate of 50 rolls per day in each of the above-changed conditions of the processor. After the completion of the continuous processing, each of the samples wedgewise exposed to light in an ordinary manner was processed and the stain and scratches formed on the processed film were evaluated in the same manner as in Example 5. The length $L_1$ and the transporting speed of the light-sensitive material were fixed at 100 cm and 60 cm/min., respectively. Thus obtained results are listed in Table 6.

TABLE 6

| Exp. No. | $L_2$ (cm) | $L_2/L_1$ | Opening area ratio ($K\ cm^2/l$) | $K \times L_1/S$ | Scratch | Stain ΔD | Note |
|---|---|---|---|---|---|---|---|
| 6-1 | 5 | 0.05 | 60 | 100 | 1 | 0.15 | Comparative |
| 6-2 | 2 | 0.02 | 35 | 58.33 | 3 | 0.04 | Inventive |
| 6-3 | 3 | 0.03 | 35 | 58.33 | 4 | 0.02 | Inventive |
| 6-4 | 4 | 0.04 | 35 | 58.33 | 5 | 0.01 | Inventive |

TABLE 6-continued

| Exp. No. | $L_2$ (cm) | $L_2/L_1$ | Opening area ratio ($K\ cm^2/l$) | $K \times L_1/S$ | Scratch | Stain ΔD | Note |
|---|---|---|---|---|---|---|---|
| 6-5 | 5 | 0.05 | 35 | 58.33 | 5 | 0.00 | Inventive |
| 6-6 | 7 | 0.07 | 35 | 58.33 | 5 | 0.01 | Inventive |
| 6-7 | 10 | 0.10 | 35 | 58.33 | 4 | 0.03 | Inventive |
| 6-8 | 11 | 0.11 | 35 | 58.33 | 3 | 0.05 | Inventive |

As is shown in Table 6, the scratches and stain formed on the light-sensitive material can be inhibited and the effects of the invention can be enhanced when the Ratio of $L_2/L_1$ is within the range of from 0.03 to 0.10.

Example 7

The ratio of opening area K in $cm^2$/liter and the circulation amount of the developer were changed as shown in Table 7. A sample of light-sensitive material the same as that used in Experiment 5-5 was continuously for 10 days in a rate of 100 rolls per day, and the stability of gradation was determined in the same procedure as in Example 2. The formation of scratches was evaluated in the same manner as in example 5. The stain was measure by the transmission density at 660 nm. The length $L_1$ and the transporting speed of the light-sensitive material were fixed at 100 cm and 60 cm/min., respectively. Thus obtained results are listed in Table 7.

TABLE 7

| Exp. No. | Circulation amount | Opening area ration K ($cm^2/l$) | $K \times L_1/S$ | Gradation stability $\Delta\gamma$ | Stain $\Delta D$ | Scratch | Note |
|---|---|---|---|---|---|---|---|
| 7-1 | 5 | 60 | 100 | −0.15 | 0.12 | 1 | Comparative |
| 7-2 | 0.5 | 35 | 58.33 | 0.05 | 0.03 | 3 | Inventive |
| 7-3 | 1 | 35 | 58.33 | 0.02 | 0.01 | 4 | Inventive |
| 7-4 | 3 | 35 | 58.33 | 0.01 | 0.00 | 5 | Inventive |
| 7-5 | 5 | 35 | 58.33 | 0.00 | 0.00 | 5 | Inventive |
| 7-6 | 7 | 35 | 58.33 | 0.01 | 0.01 | 5 | Inventive |
| 7-7 | 10 | 35 | 58.33 | 0.03 | 0.03 | 4 | Inventive |
| 7-8 | 11 | 35 | 58.33 | 0.05 | 0.05 | 3 | Inventive |

As is shown in Table 7, the high stability of gradation can be obtained even by the rapid processing and the formation of scratch and stain can be inhibited and the effects of the invention can be enhanced when the circulation amount of the processing solution in the first processing tank is within the range of from 1 liter to 10 liter.

What is claimed is:

1. A method for processing a silver halide photographic light-sensitive material comprising the step of processing a color silver halide photographic material by a processing apparatus having the first processing tank in which the light-sensitive material is firstly processed, a turning portion positioned outside the processing solution between the first processing tank and the next processing tank, wherein the silver halide color photographic light-sensitive material has a coated silver amount of from 3.0 $g/m^2$ to 10.0 $g/m^2$, and a value of $R \times L_1/S$ is within the range from 1.5 to 5.0, when R is a curvature radius in centimeter of the turning portion, $L_1$ is a length in centimeter of the portion of the first processing tank at which the light-sensitive material is immersed in a processing solution, S is a transportation speed of the light-sensitive material in the processor in centimeter per minute.

2. The method of claim 1, wherein said turning portion has a plurality of curvature radius.

3. The method of claim 1, wherein a ratio, $L_2/L_1$, of a passing length of light-sensitive material in said turning portion $L_2$ in centimeter to said length $L_1$ is within the range of from 0.03 to 0.10.

4. A method for processing a silver halide photographic light-sensitive material comprising the step of processing a color silver halide photographic material by a processing apparatus having the first processing tank in which the light-sensitive material is firstly processed, a turning portion positioned outside the processing solution between the first processing tank and the next processing tank, wherein the silver halide color photographic light-sensitive material has a coated silver amount of from 3.0 $g/m^2$ to 10.0 $g/m^2$, and a value of $L_1 \times K/S$ is within the range of from 26 to 70, when $L_1$ is a length in centimeter of the portion of the first processing tank at which the light-sensitive material is immersed in a processing solution, S is a transportation speed of the light-sensitive material in the processor in centimeter per minute, and K is an opening ratio in $cm^2$/liter of the first processing tank.

5. The method of claim 4, wherein a ratio, $L_2/L_1$, of a passing length of light-sensitive material in said turning portion $L_2$ in centimeter to said length $L_1$ is within the range of from 0.03 to 0.10.

6. The method of claim 4, wherein a circulation amount of the processing solution in the first processing tank is within the range of from 1 liter/min. to 10 liter/min.

* * * * *